US011491498B2

(12) United States Patent
Butzke et al.

(10) Patent No.: US 11,491,498 B2
(45) Date of Patent: Nov. 8, 2022

(54) SHOWER JET OUTLET DEVICE AND SHOWER DEVICE EQUIPPED THEREWITH

(71) Applicant: Hansgrohe SE, Schiltach (DE)

(72) Inventors: Klaus Butzke, Schiltach (DE); Steffen Erath, Seedorf (DE); Guenter Glunk, Fluorn-Winzeln (DE); Marc Kalmbach, Aichhalden (DE)

(73) Assignee: Hansgrohe SE, Schiltach (DE)

( * ) Notice: Subject to any disclaimer, the term of this patent is extended or adjusted under 35 U.S.C. 154(b) by 213 days.

(21) Appl. No.: 15/846,551

(22) Filed: Dec. 19, 2017

(65) Prior Publication Data

US 2018/0178225 A1 Jun. 28, 2018

(30) Foreign Application Priority Data

Dec. 22, 2016 (DE) ..... 102016225987.3

(51) Int. Cl.

| | |
|---|---|
| ***B05B 1/18*** | (2006.01) |
| ***B05B 15/528*** | (2018.01) |
| ***B05B 1/30*** | (2006.01) |
| ***E03C 1/04*** | (2006.01) |

(52) U.S. Cl.

CPC ..... *B05B 1/185* (2013.01); *B05B 1/3006* (2013.01); *B05B 15/528* (2018.02); *E03C 1/0408* (2013.01)

(58) Field of Classification Search

CPC .. B05B 1/10; B05B 1/18; B05B 1/185; B05B 1/3006; B05B 15/525; B05B 15/528; E03C 1/0408

USPC ..... 239/533.13, 533.14, 548–568, 602

See application file for complete search history.

(56) References Cited

U.S. PATENT DOCUMENTS 1,236,617 A 8/1917 Speakman
2,261,500 A * 11/1941 Lewis ..... B05B 1/18 239/557
2,402,741 A 6/1946 Draviner
(Continued)

FOREIGN PATENT DOCUMENTS

CN 203108678 U 8/2013
CN 205518284 U † 8/2016
(Continued)

OTHER PUBLICATIONS

Office Action (in Chinese Language and English Translation) issued by the Japanese Patent Office, dated Jan. 8, 2019, in Japanese Patent Application No. 2017-243737.
(Continued)

*Primary Examiner* — Cody J Lieuwen
(74) *Attorney, Agent, or Firm* — Bose McKinney & Evans LLP

(57) ABSTRACT

A shower jet outlet device and a shower head equipped therewith have a jet disk with at least one jet disk opening and a jet outlet element disposed in the jet disk opening. The jet outlet element is pot-shaped with an outlet-side bottom, a side wall and a hollow chamber delimited by the bottom and the side wall. The bottom faces in the jet outlet direction and includes fine jet openings. The bottom and the side wall are made of an elastic material and the jet outlet element is configured to deform by bulging of its bottom and/or its side wall, in response to fluid pressure in the hollow chamber when operating.

16 Claims, 5 Drawing Sheets

(56) References Cited

U.S. PATENT DOCUMENTS

Figure 1:
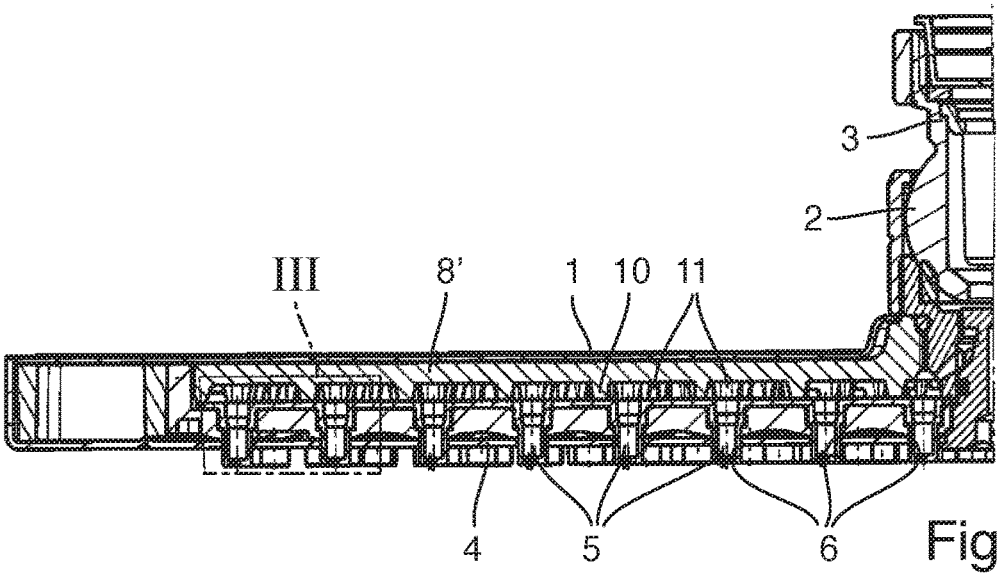

| | | | | |
|---|---|---|---|---|
| 2,862,766 | A * | 12/1958 | Ward | A45D 19/02 239/562 |
| 3,734,410 | A | 5/1973 | Bruno | |
| 3,830,432 | A | 8/1974 | Grohe | |
| 5,228,625 | A * | 7/1993 | Grassberger | B05B 15/528 239/558 |
| 5,246,301 | A | 9/1993 | Hirasawa | |
| 5,699,964 | A * | 12/1997 | Bergmann | B05B 1/185 239/106 |
| 5,730,361 | A * | 3/1998 | Thonnes | B05B 15/528 239/106 |
| 6,113,002 | A * | 9/2000 | Finkbeiner | B05B 1/185 239/106 |
| 6,209,799 | B1 | 4/2001 | Finkbeiner | |
| 6,378,790 | B1 | 4/2002 | Paterson et al. | |
| 6,382,531 | B1 * | 5/2002 | Tracy | B05B 1/185 239/548 |
| 7,055,767 | B1 * | 6/2006 | Ko | B05B 15/654 239/587.4 |
| 8,985,483 | B2 | 3/2015 | Petrovic | |
| 9,839,923 | B2 | 12/2017 | Ramos De Barros | |
| 2003/0038189 | A1 | 2/2003 | Titinet | |
| 2003/0062426 | A1 * | 4/2003 | Gregory | B05B 1/185 239/107 |
| 2004/0118948 | A1 * | 6/2004 | Drennow | B05B 1/14 239/548 |
| 2004/0227019 | A1 * | 11/2004 | Okubo | B05B 1/185 239/559 |
| 2011/0101132 | A1 | 5/2011 | Nordstrom | |
| 2012/0103186 | A1 | 5/2012 | Pierquin et al. | |
| 2014/0014743 | A1 | 1/2014 | Schorn et al. | |
| 2016/0332173 | A1 | 11/2016 | Butzke et al. | |
| 2017/0165687 | A1 * | 6/2017 | Ukigai | B05B 1/22 |
| 2018/0099295 | A1 | 4/2018 | Armbruster et al. | |

FOREIGN PATENT DOCUMENTS

| | | | | |
|---|---|---|---|---|
| DE | 2215344 | B1 | | 8/1973 |
| DE | 10 2006 032 017 | B3 | | 1/2008 |
| DE | 10 2014 200 741 | A1 | | 7/2015 |
| EP | 0894536 | A2 | | 2/1999 |
| EP | 1700636 | A2 | | 9/2006 |
| EP | 2 684 610 | A1 | | 1/2014 |
| JP | 2013215325 | A | | 10/2013 |
| RU | 2534086 | A | | 11/2014 |
| WO | 95/22407 | A1 | | 8/1995 |
| WO | 1996/000617 | | † | 1/1996 |
| WO | 9600617 | A1 | | 1/1996 |
| WO | 2009126987 | A1 | | 10/2009 |
| WO | 2014029636 | A2 | | 2/2014 |

OTHER PUBLICATIONS

European Search Report issued by the European Patent Office, dated Apr. 20, 2018, for European Application No. EP17206774; 7 pages.

Search Report and Written Opinion issued by the Intellectual Property Office of Singapore dated Apr. 2, 2018 for Singapore Patent Application No. 10201710568U; 7 pages.

Search Report issued by the European Patent Office, dated Feb. 7, 2018, for European Patent Application No. EP17194704; 7 pages.

Russian language and English translation of Decision on Granting a Patent for Invention issued by The Federal Service for Intellectual Property, Patents and Trademarks, dated Aug. 8, 2018, for Russian Patent Application No. 2017143848/05(075392); 15 pages.

Search Report (in Russian language) issued by The Federal Service for Intellectual Property, Patents and Trademarks dated Aug. 8, 2018, for Russian Patent Application No. 2017143848/05(075392); 2 pages.

* cited by examiner
† cited by third party

SHOWER JET OUTLET DEVICE AND SHOWER DEVICE EQUIPPED THEREWITH

The invention relates to a shower jet outlet device comprising a jet disc which includes at least one jet disc opening, and comprising a jet outlet element disposed in the jet disc opening, and to a shower device comprising such a shower jet outlet device. The shower device in question can be for example a sanitary showering device, such as an overhead, hand-held or side shower device, or a shower device at the outlet of a sanitary water-dispensing or mixer tap for a bathtub or a washbasin or sink, such as a kitchen shower device for a kitchen sink.

Shower jet outlet devices of this type are variously known in particular for sanitary shower devices. Thus, laid-open publication EP 2 684 610 A1 discloses a shower device comprising such a shower jet outlet device in which the jet disc includes a plurality of jet disc openings and the jet outlet elements are formed hollow-cylindrically from elastomer material with a continuous hollow duct as jet outlet opening and are moulded to a common jet outlet plate abutting on the inner side of the jet disc. Such cylindrical jet outlet elements composed of an elastomer material are also referred to as jet outlet nipples or as nipples for short.

In the case of a further shower device of this type that is disclosed in laid-open publication DE 10 2014 200 741 A1, multi-duct jet outlet units having in each case at least two fluid-separated outlet ducts are provided for the shower jet outlet device. The various outlet ducts of the respective jet outlet unit open on the inlet side into separate fluid outlet chambers, with the result that the fluid can be optionally and selectively fed in each case to one of the outlet ducts in order for example to provide different shower jet types. Hollow-cylindrical jet outlet elements or nipples made of elastomer material function as jet outlet units, with the outlet ducts extending continuously from one to the other cylinder end side, for example in parallel next to one another or in a coaxial arrangement. Here too, the nipples are preferably formed integrally with and on a steel outlet plate made of the elastomer material, said plate being disposed on the inner side of the jet disc.

Patent publication U.S. Pat. No. 5,246,301 discloses a brush-like shower head with brush projections which function as jet outlet elements with a single-duct or two-duct design. The jet outlet projections are of cylindrical, conically tapering form and, in the single-duct design, have an outlet duct which extends longitudinally through the projection or an outlet duct which opens out on the cylinder side wall. In the two-duct design, the respective projection has one outlet duct which leads through longitudinally and centrally and one outlet duct which extends on the inlet side laterally of the former central outlet duct and opens out on the projection side wall.

A shower jet outlet device disclosed in laid-open publication WO 95/22407 A1 comprises a ring-shaped bottom piece made of elastic material, said bottom piece being provided with water passing openings at an output side and abutting with its side walls against side walls of a corresponding ring channel of a shower head housing so as to be fixed in the shower head. In case of forming the output-side bottom portion of said bottom piece to be inwardly curved or to be plane the bottom portion may bend outwardly in response to water pressure to assist in a detaching of lime in the area of the water passing openings.

Specifically in sanitary applications, shower jet outlet devices are typically designed for the provision of one or more, selectively choosable shower jet types, for example for the provision of a massage jet, a normal jet, a surge jet or a needle jet or fine jet. To obtain such a so-called fine/needle jet, it is known practice to provide a jet disc which has comparatively small jet disc openings which function as jet outlet openings of the shower device and accordingly as fine jet openings. A thin metal disc in which the fine jet openings can be incorporated relatively simply in terms of manufacturing conventionally serves for this purpose as a jet disc. Owing to their relatively small passage cross section, these fine jet openings are very sensitive to clogging by dirt particles and calcification, for which reason shower jet outlet devices of this type have already been proposed with a changeable metal jet disc.

It is an object of the invention to provide a shower jet outlet device of the type stated at the outset which can be produced and operated with relatively little effort and allows functionally reliable fine jet shower operation with comparatively fine individual jets as required, with said operation being relatively insensitive to clogging by dirt particles and calcification.

The invention achieves this and other objects by providing a shower jet outlet device and a shower device equipped therewith, said shower jet outlet device having a jet disk including at least one jet disk opening and a jet outlet element that is pot-shaped with an outlet-sided bottom, a side wall and a hollow chamber delimited by the bottom and the side wall. The jet outlet element is arranged, with its bottom facing in the jet outlet direction, in the associated jet disc opening and thus preferably held on the jet disc and has in its bottom a plurality of spaced-apart fine jet openings which extend through the bottom. This creates the precondition of being able, as required, to provide a very fine shower jet which can in particular be a mist-like fine shower jet.

The bottom and the side wall of the jet outlet element are composed of an elastic material, preferably in one part from the same elastic material. Optionally, the entire jet outlet element can be produced in one part from this elastic material. The elastic material can in particular be an elastomer material, such as, for example, a conventional silicone-based elastomer material. The jet outlet element is configured such that it deforms by bulging of its bottom and/or its side wall, in response to a fluid operating pressure present in the hollow chamber. What is meant by fluid operating pressure here is a pressure of the fluid supplied to the shower device that occurs when the shower device is used as intended. This deformation of the jet outlet element by the fluid operating pressure occurring during operation of the shower jet outlet device particularly advantageously prevents functional failures or functional limitations caused by dirt particles and calcification. The deformation makes it more difficult for dirt and lime particles to adhere, and any already adhering contaminants or lime particles can be detached or removed easily and simply. This can significantly reduce the required cleaning effort for the shower jet outlet device. Here, the increasing deformation of the jet outlet element with higher fluid operating pressure promotes a self-cleaning function of the shower jet outlet device in operation by virtue of the fact that an incipient clogging of the fine jet openings, for example caused by incipient lime deposits, leads to an increased fluid operating pressure in the hollow chamber of the jet outlet element, whereby the deformation is increased, as a result of which the incipient clogging of the shower can be automatically released again or dislodged.

As a result, this shower jet outlet device according to the invention can be produced and operated in a functionally reliable manner with relatively little outlay. The fine jet openings can be incorporated in the bottom of the jet outlet element with a relatively small passage or outlet cross section. Fed-in shower fluid enters the hollow chamber of the pot-shaped jet outlet element and from there can exit the shower jet outlet device through the fine jet openings as a fine/needle jet. The pot-shaped design of the jet outlet element can keep low the susceptibility of the shower jet outlet device to clogging of the fine jet openings on account of accumulating dirt/lime particles and facilitate the removal of any adhering dirt/lime particles. A contributing factor to this is that, owing to the pot-shaped design of the jet outlet element, the length of the fine jet openings through which the flow is to pass is limited to the wall thickness of the bottom which can be kept considerably smaller than the overall axial length of the jet outlet element, in corresponding embodiments less than a fifth or even less than a tenth thereof.

The shower jet outlet device according to the invention can have any desired number of such jet outlet elements corresponding to the number of associated jet disc openings, preferably a plurality of jet outlet elements which are arranged in a uniformly distributed manner over the extent of an associated jet disc surface.

Depending on the requirement, the one or more jet outlet elements can terminate with its/their bottom externally flush with the jet disc or be somewhat set back from the outer side thereof or preferably project outwardly beyond the jet disc. In the latter case, it can be further preferred if the jet outlet element also additionally projects outwardly beyond the jet disc by a region of its side wall that adjoins the bottom. In corresponding embodiments, the jet outlet element projects outwardly beyond the jet disc by more than half the axial length of its side wall. This promotes the fluid-pressure-dependent deformation of the jet outlet element and in particular of its side wall, unhindered by the jet disc.

In a development of the invention, the fine jet openings are produced with a passage cross section of in each case at most 0.2 $mm^2$, in particular of in each case at most 0.1 $mm^2$. This dimensioning measure allows the provision of a correspondingly fine shower jet.

In a development of the invention, an outer diameter of the bottom and of the side wall of the jet outlet element is at most 10 mm, in particular at most 6 mm, in corresponding applications even only at most 5 mm or at most 4 mm. This dimensioning measure can also be beneficial for achieving a very fine shower jet.

In a development of the invention, the bottom of the jet outlet element has at least three and at most ten fine jet openings. This dimensioning measure can also be favourable in terms of manufacture and advantageous with respect to the achievable shower jet characteristics.

In a development of the invention, the jet outlet element is arranged in the jet disc opening to be displaceable, i.e. translationally movable, parallel to the jet outlet direction between a backward end position and forward end position, wherein the jet outlet element is situated in the forward end position, when the fluid operation pressure is present in the hollow chamber, and is situated in the backward end position, when there is no fluid operation pressure. This can in many cases have functional advantages. In the backward end position jet outlet element may be fully retracted into the jet disc opening, e.g. so as to end flush with the same or to be back of the same. Alternatively, the jet outlet element in its backward end position is retracted in the jet disc opening only with a back portion. In the forward end position jet outlet element may be situated e.g. at least with its bottom outside of the jet disc opening, in corresponding embodiments in addition with a minor or, alternatively, a major part of its side wall. This favours the bulging deformation of the jet outlet element, in particular of its bottom and/or its side wall, under the action of the fluid operation pressure in the hollow chamber. In corresponding embodiments the jet outlet element is guided to be displaceable as a whole in the jet disc opening, or is alternatively hold with a backward portion at the jet disk or at a shower device part arranged at the backside of the jet disk so as to be forward movable under fluid pressure with its bottom and preferably also with its side wall, e.g. elastically. Preferably the jet outlet element is arranged to elastically self-return to the backward end position, so that it moves automatically back to the backward end position when the fluid pressure decreases.

In an advantageous refinement, the jet outlet element is configured in such a way that, in relation to a non-pressurized condition, the diameter of its side wall and/or a passage cross section of its fine jet openings are/is increased by the bulging of the bottom and/or of the side wall by at least 3% at a fluid operating pressure of 0.5 bar, and/or are/is increased by at least 8% at a fluid operating pressure of 1 bar, and/or are/is increased by at least 12% at a fluid operating pressure of 1.5 bar. It is shown that this system design for the jet outlet element results in a sufficiently good protection from rapid clogging by dirt particles and/or lime deposits precisely during use in sanitary shower devices in which the water operating pressure typically lies in this range.

In another refinement of this measure, the bottom and the side wall of the jet outlet element are composed of an elastomer material having a Shore A hardness of at most 75, in particular of at most 40. It is shown that, with this system design of the jet outlet element, the bulging deformation of the jet outlet element is also assisted in a favourable manner in response to the fluid operating pressure.

In a development of the invention, the jet outlet element includes a holding shoulder radially salient from the side wall. This can be used to securely hold the jet outlet element on the jet disc or an adjacent component.

In a development of the invention, the jet outlet element includes spacers axially projecting on its inlet-sided face end. This can be used to hold the jet outlet element between the jet disc and a, for example plate- or disc-shaped, housing wall or intermediate wall of the shower device that is disposed at a distance from the inner side of the jet disc, against which wall the jet outlet element abuts by way of its axially projecting spacer. Here, the jet disc and the housing wall or intermediate wall can have formed between them a fluid outlet chamber to which the shower fluid is supplied and from which the shower fluid can pass into the hollow chamber of the jet outlet element.

In a development of the invention, the jet disc has a plurality of jet disc openings in which a corresponding number of jet outlet elements are disposed, wherein the jet outlet elements are moulded integrally to a jet outlet plate abutting on an interior side of the jet disc and made of elastic material. In this case too, the material can again in particular be an elastomer material which is conventional per se. The integral moulding of the jet outlet elements to the jet outlet plate can simplify the production of the jet outlet elements and the placing thereof in the jet disc openings.

The shower device according to the invention is equipped with a shower jet outlet device according to the invention. The shower device can in particular be a sanitary shower device, for example a showering device embodied as an overhead shower device, hand-held shower device or side shower device.

Figure 2:
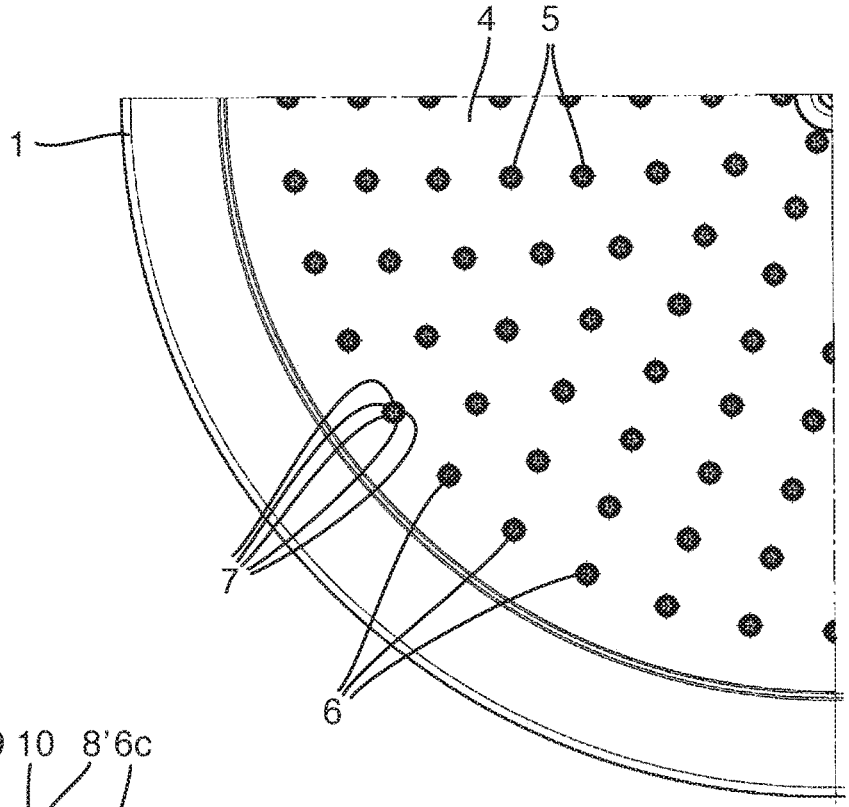
Figure 3:
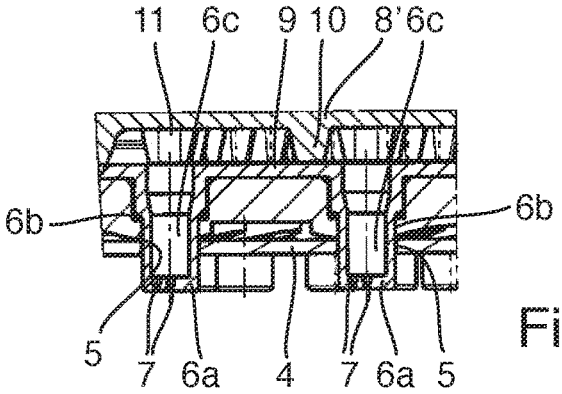
Figure 4:
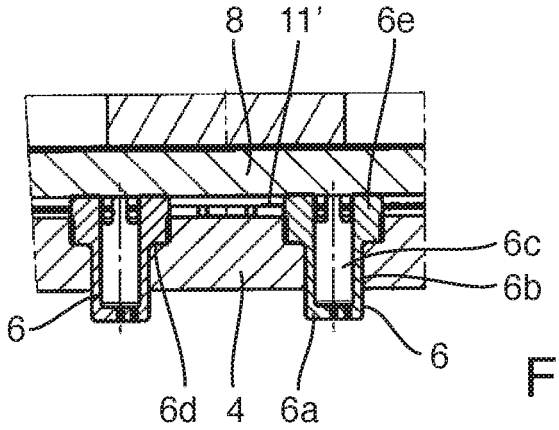
Figure 6:
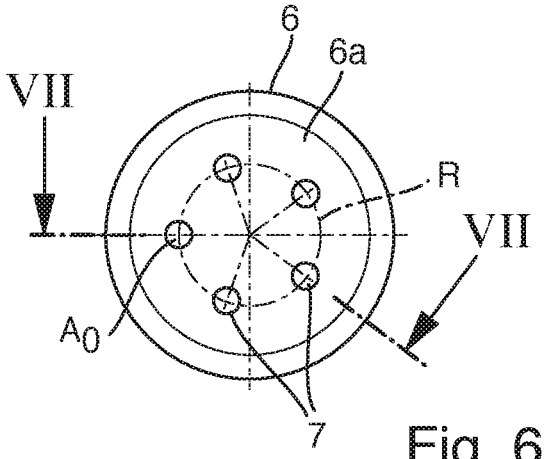
Figure 5:
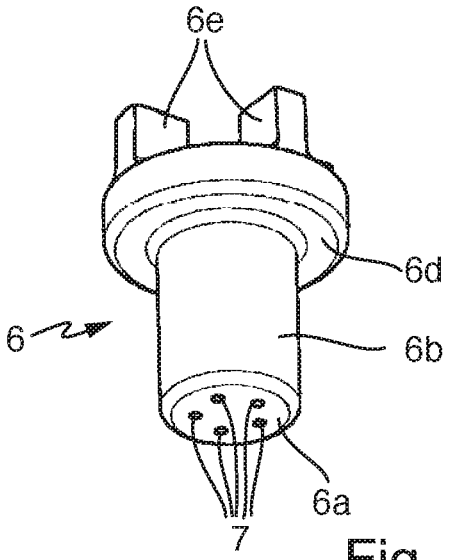
Figure 7:
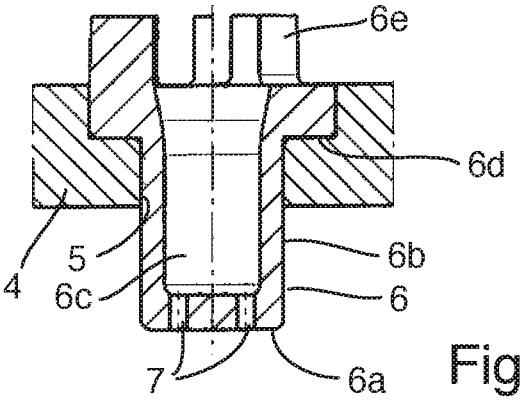
Figure 8:
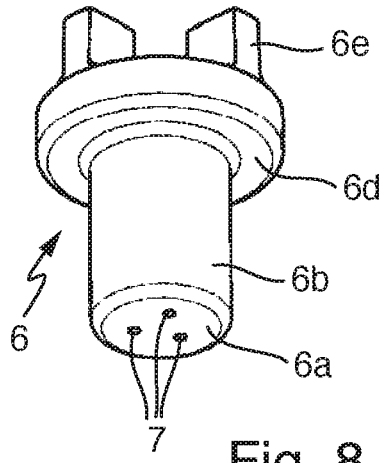
Figure 9:
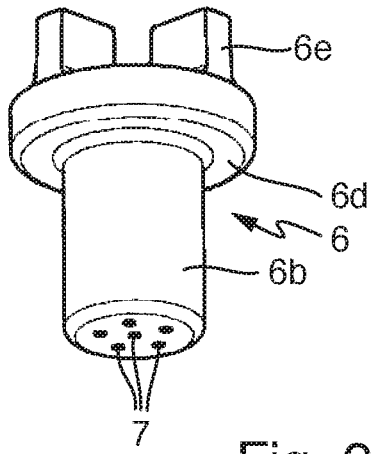
Figure 10:
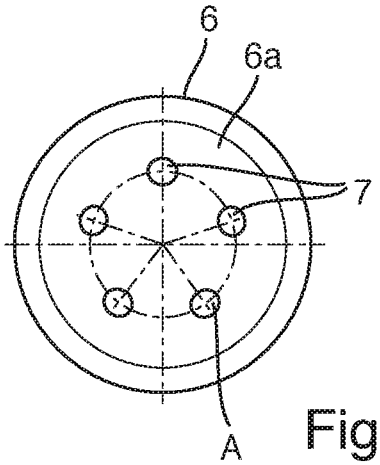
Figure 11:
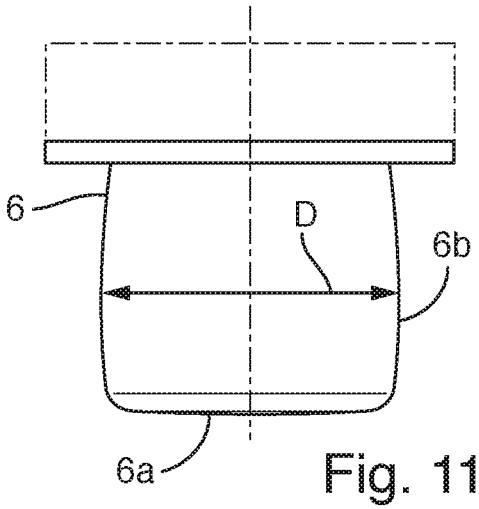
Figure 12:
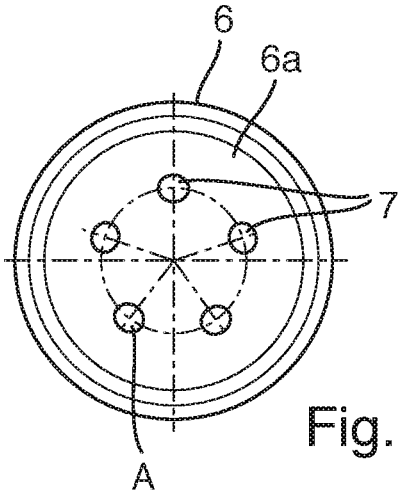
Figure 13:
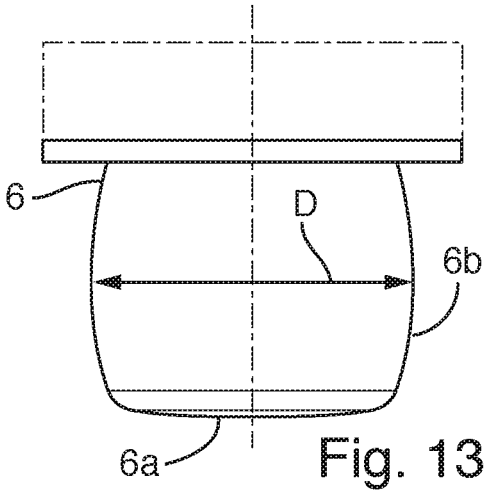
Figure 14:
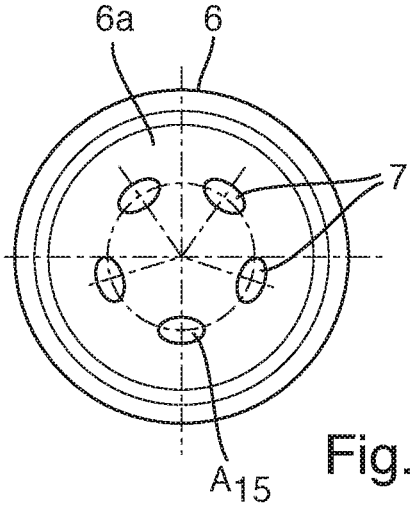
Figure 15:
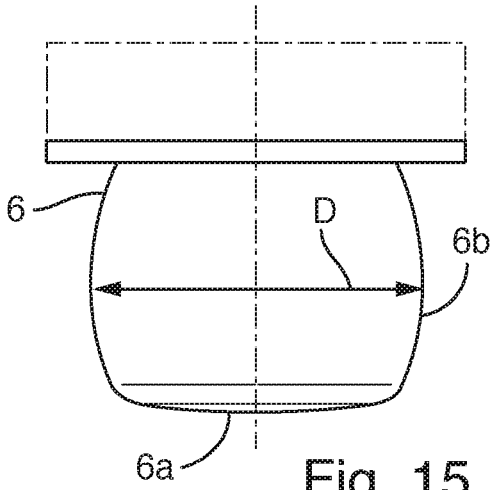
Figure 16:
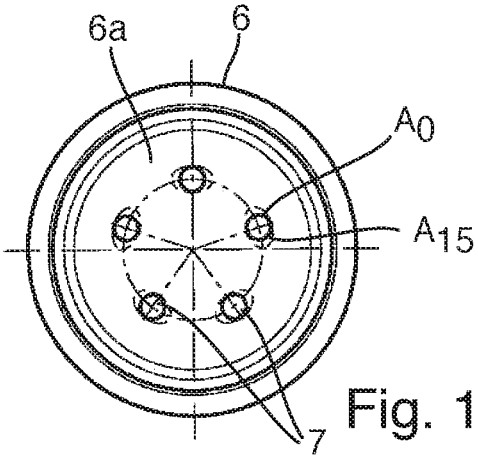
Figure 17:
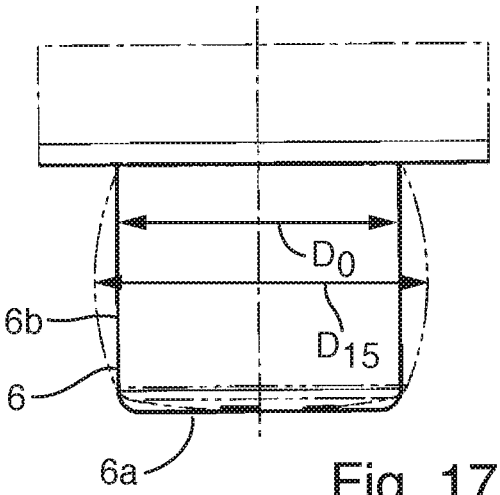
Figure 18:
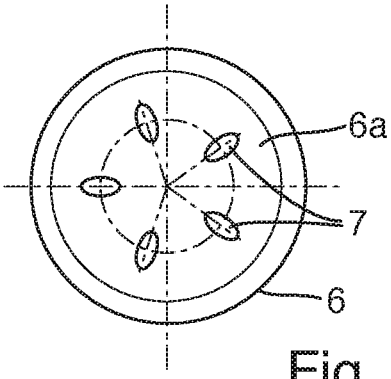
Figure 19:
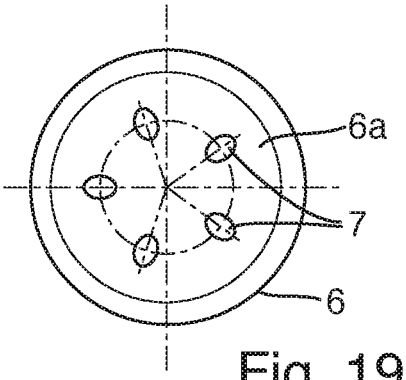
Figure 20:
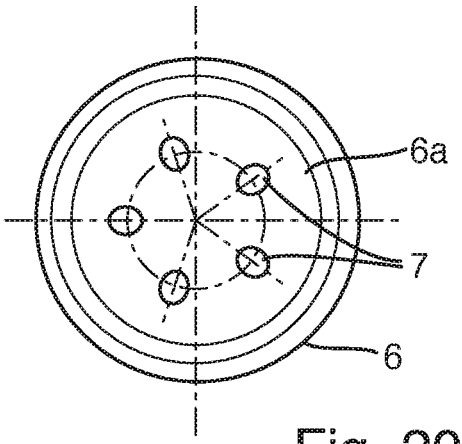
Figure 21:
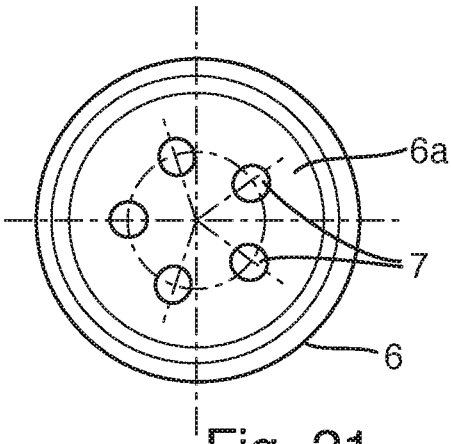

Advantageous embodiments of the invention are illustrated in the drawings and are described below. In the drawings:

FIG. 1 shows a half longitudinal sectional view of a shower device having jet outlet elements moulded integrally to a jet outlet plate, FIG. 2 shows a partial plan view from below of a quarter circle of the shower device of FIG. 1, FIG. 3 shows a detail view of a region III of FIG. 1, FIG. 4 shows the detail view of FIG. 3 for a shower device variant with individually arranged jet outlet elements, FIG. 5 shows a perspective view of one of the jet outlet elements in FIG. 4, FIG. 6 shows a plan view of a bottom of the jet outlet element of FIG. 5, FIG. 7 shows a sectional view of the jet outlet element of FIG. 5 along a line VII-VII in FIG. 6, FIG. 8 shows a perspective view corresponding to FIG. 5 for an embodiment variant of the jet outlet element, FIG. 9 shows a perspective view corresponding to FIG. 5 for a further embodiment variant of the jet outlet element, FIG. 10 shows a bottom view of the jet outlet element corresponding to FIG. 6 with a prevailing fluid operating pressure of 0.5 bar, FIG. 11 shows a side view of the jet outlet element in the pressurized condition of FIG. 10, FIG. 12 shows the bottom view of FIG. 10 with a fluid operating pressure of 1.0 bar, FIG. 13 shows the side view of FIG. 11 in the pressurized condition of FIG. 12, FIG. 14 shows the bottom view of FIG. 10 with a fluid operating pressure of 1.5 bar, FIG. 15 shows the side view of FIG. 11 in the pressurized condition of FIG. 14, FIG. 16 shows a comparative bottom view for the operating conditions in the non-pressurized condition according to FIG. 10 and in the pressurized condition according to FIG. 14, FIG. 17 shows a comparative side view for the non-pressurized condition according to FIG. 11 and the pressurized condition according to FIG. 15, FIG. 18 shows the bottom view of FIG. 6 in the non-pressurized condition for an embodiment variant of the jet outlet element, FIG. 19 shows the bottom view of FIG. 18 at a fluid operating pressure of 0.5 bar, FIG. 20 shows the bottom view of FIG. 18 at a fluid operating pressure of 1.0 bar, and FIG. 21 shows the bottom view of FIG. 18 at a fluid operating pressure of 1.5 bar.

The shower device shown by way of example in FIGS. 1 to 3 as a possible exemplary embodiment of the invention is of a flat design known per se, as used for example for sanitary overhead shower devices. The shower device has a flat, circular cylindrical shower housing 1 which is held on an inlet-side inlet nozzle 3, which is longitudinally central in the shower device, by means of a ball joint 2 so as to be correspondingly pivotable on all sides. On the outlet side, the shower housing 1 terminates with a shower jet outlet device which includes a jet disc 4 which is provided with at least one jet disc opening 5, in the example shown with a plurality, for example about 150 to 200, jet disc openings which are distributed uniformly over the jet disc 4.

As a further constituent part of the shower jet outlet device, a jet outlet element 6 is arranged in each case in each jet disc opening 5. The jet outlet element 6 is pot-shaped with an outlet-sided bottom 6*a*, a side wall 6*b* and a hollow chamber 6*c* delimited by the bottom and the side wall, said element being arranged with its bottom 6*a* facing in the jet outlet direction, i.e. the bottom 6*a* forms the outlet-side end face of the respective jet element 6. In FIG. 1, the jet outlet direction points from the top downwards in the region of the jet disc 4, and the bottom 6*a* forms the lower end face of the jet outlet elements 6. The bottom 6*a* of each jet outlet element 6 has a plurality of fine jet openings 7, in each case five fine jet openings 7 in the example shown in FIGS. 1 to 3.

In the exemplary embodiment of FIGS. 1 to 3, the jet outlet elements 7 are moulded integrally to a jet outlet plate 9 which is arranged facing an inner side of the jet disc 4, for example abuts an inner side of the jet disc 4. The jet outlet plate 9 is produced from an elastic material which can be in particular a conventional silicone-based elastomer material. A housing plate or intermediate plate 8' of the shower device is disposed on the inner side of the jet outlet plate 9 which, by virtue of its elastic nature, is also referred to as an outlet mat, the housing plate/intermediate plate 8' being provided with spacing projections 10 or spacing webs such that an intermediate space 11 functioning as a fluid outlet chamber remains between said plate 8' and the steel outlet plate 9, into which intermediate space the jet outlet elements 6 open on the inlet side, i.e. with their open pot side. In this way, fluid supplied to the shower device is distributed or guided via this fluid outlet chamber into the hollow chamber 6*d* of the individual jet outlet elements 6 and from there can exit the shower device as a fine/needle jet through the fine jet openings 7.

FIG. 4 shows in a detail view corresponding to FIG. 3 an embodiment variant of the shower device of FIGS. 1 to 3 in which the jet outlet elements 6 are produced as individual parts and held in the shower device. For this purpose, they are inserted from inside into the respectively associated jet disc opening 5 of the jet disc 4 and held in this position by a housing plate or intermediate plate 8 of the shower device that is laid against them on the inner side of the shower device. To this end, as can be seen in more detail from FIGS. 5 and 7, the jet outlet element 6 has a holding shoulder 6*d* salient radially from the side wall 6*b* and a spacer 6*e* axially projecting on its inlet-sided face end. In the example shown, the spacer 6*e* includes a plurality of spacing webs which are arranged with a spacing in the circumferential direction of the circular ring-shaped upper, inlet-sided edge of the jet outlet element 6 and project axially from this edge. In this way, a clearance remains between the spacing webs of the spacer 6*e*, through which clearance shower fluid which is supplied to the shower device can flow via the upper, inlet-sided pot opening of the pot-shaped outlet element 6 into the hollow chamber 6*c* thereof. Here, an axial spacing between the housing plate or intermediate plate 8 and the jet disc 4 forms a fluid-outlet chamber 11' from which the jet outlet elements 6 open and via which the fluid supplied to the shower device can be distributed to the plurality of jet outlet elements 6.

In the two exemplary embodiments of FIGS. 1 to 4, the jet outlet elements 6 each project outwardly beyond the jet disc 4 in the jet outlet direction with their bottom 6*a* and an adjoining region of their side wall 6*b*, for example by about a fifth to a third of their overall axial length. This can be advantageous, for example, for periodic manual cleaning operations. In addition, moreover, the embodiment of FIG. 4 with the individual jet outlet elements 6 corresponds in terms of function and properties to the shower jet outlet device of the embodiment of FIGS. 1 to 3, and therefore, for the sake of simplicity, reference will be made below in relation to the further FIGS. 8 to 21 to the embodiment variant with the individual, separately produced jet outlet elements.

Since the wall thickness of the bottom 6*a* is significantly smaller that the axial length of the jet outlet element 6, for example only about a fifth to a twentieth of the axial length of the jet outlet element 6, the fine jet openings 7 can be incorporated into the elastic material of the bottom 6*a* in a comparatively simple manner in terms of manufacturing and with a comparatively small passage cross section.

FIGS. 5 to 7 show the relevant jet outlet element 6 in the non-pressurized condition in an embodiment with five cross-sectionally circular fine jet openings 7 which are incorporated into the bottom 6*a* as axial passage ducts while being distributed equidistantly on an identical radius R and in the circumferential direction. FIG. 8 shows an embodiment variant which corresponds to that of FIGS. 5 to 7 with the sole difference that, instead of the five, only three fine jet openings 7 are arranged at an angular distance of 120° from one another in the bottom 6*a* of the jet outlet element 6. FIG. 9 shows a further embodiment variant in which, as the sole difference from the embodiment according to FIGS. 5 to 7, the jet outlet element 6 has in its bottom 6*a* six instead of five fine jet openings 7, specifically an additional, central, sixth fine jet opening in comparison to the embodiment variant of FIGS. 5 to 7.

In further alternative embodiments, the fine jet openings 7 do not, as can be seen for example from FIG. 7, all extend parallel to one another along a longitudinal axis of the jet outlet element 6, but at least some of them extend obliquely to the longitudinal axis of the jet outlet element 6 and/or obliquely to other of the fine jet openings 7. For example, the fine jet openings 7 can extend so as to diverge obliquely outwards or converge obliquely inwards at an oblique angle of 15° or less to the longitudinal axis of the jet outlet element 6 or extend obliquely towards one side in a synchronous manner to one another. The oblique angle can be equal for all fine jet openings 7, or, alternatively, be different for at least two fine jet openings 7. In further alternative embodiments, in addition to the fine jet openings 7 in the bottom 6*a*, one or more fine jet openings can be provided in a region of the side wall 6*b* of the jet outlet element 6 that projects beyond the jet disc 4.

As already mentioned in relation to the embodiment of FIGS. 1 to 3, the individual jet outlet elements 6 in the embodiment variants of FIGS. 4 to 9 are also made of an elastic material, for example a silicone-based elastomer material. Preferably, here, at least the bottom 6*a* and the side wall 6*b* are made in one piece from the elastic material; in the example shown, the jet outlet element 6 is made completely in one piece as a component consisting of an elastic material. Here, the jet outlet element 6 is configured to deform during operation by bulging of its bottom 6*a* and/or its side wall 6*b*, in response to a pressure, present in the hollow chamber 6*c*, of the fluid supplied to the shower device. This is explained in more detail below with reference to the exemplary embodiment of FIGS. 5 to 7 and the further FIGS. 10 to 17.

As mentioned, FIGS. 5 to 7 show the jet outlet element in the non-pressurized condition, i.e. in the condition when no fluid pressure is present in the hollow chamber 6*c*. In the examples shown, said element has a circular cross section; in alternative embodiments, it has a different cross section, for example an oval or polygonal cross section. The jet outlet element 6 is preferably produced such that, in this non-pressurized condition, its fine jet openings 7 have a passage cross section of in each case at most about 0.2 $mm^2$, in particular at most about 0.1 $mm^2$. In addition or alternatively to this dimensioning of the fine jet openings 7, the jet outlet element 6 is preferably configured such that, in the non-pressurized condition, its outer diameter in the region of the bottom 6*a* and of the side wall 6*b* is at most about 10 mm, in particular at most about 6 mm, for example only about 4 mm.

FIGS. 10 and 11 illustrate the jet outlet element 6 in an operating condition in which an operating pressure of the supplied fluid, such as water, of about 0.5 bar prevails in the hollow chamber 6*c* or in an associated fluid supply. It can be seen that the bottom 6*a* and the side wall 6*b* of the jet outlet element 6 already begins to bulge slightly as compared with the non-pressurized condition by the prevailing fluid pressure, a diameter D of the side wall 6*b* and/or a passage cross section A of the fine jet openings 7 being typically already increased by at least 3% with respect to the non-pressurized condition as a result of the bulging. Here, by virtue of the deformation of the bottom 6*a*, the passage cross section A of the fine jet openings 7 begins to change from its circular shape in the non-pressurized condition into an oval shape which widens in the circumferential direction of the jet outlet element 6. In an experimental test on a practice specimen, there resulted for example an increase in the diameter D by about 5% from about 4 mm in the non-pressurized condition and an increase in the passage cross section A by about 6.5% from about 0.1 $mm^2$ in the non-pressurized condition.

These deformation tendencies are intensified with increasing fluid operating pressure. FIGS. 12 and 13 show the conditions corresponding to FIGS. 10 and 11 for a fluid operating pressure of about 1 bar. It is visible from FIG. 12 that the cross sections of the fine jet openings 7 are now already appreciably oval, and it can be seen from FIG. 13 that the side wall 6*c* has bulged further in its diameter D and the bottom 6*a* has bulged increasingly outwards, i.e. downwards in FIG. 13. On said practice specimen, a percentage increase in the diameter D and in the passage cross section A of the fine jet openings 7 by in each case about 11% to 13% was observed for this fluid pressure of about 1 bar. In general, the jet outlet element 6 is preferably configured such that said percentage increase for these two parameters is at least about 8% at 1 bar.

FIGS. 14 and 15 show the conditions corresponding to FIGS. 12 and 13 with the fluid operating pressure further increased to a value of about 1.5 bar. As can be seen from FIG. 14, the fine jet openings 7 have now widened so as to be appreciably oval. In said practice specimen, an increase in the passage cross section A at this pressure of about 1.5 bar by somewhat over 80% with respect to the non-pressurized condition was determined. It can be seen from FIG. 15 that the side wall 6*b* has bulged further, i.e. increased, in terms of its diameter D and the bottom 6*a* has bulged further outwards, i.e. downwards in FIG. 15. The latter results in the aforementioned oval widening of the fine jet openings 7.

FIGS. 16 and 17 illustrate the conditions for the state at the fluid pressure of about 1.5 bar according to FIGS. 14 and 15 in a comparison arrangement with the non-pressurized condition according to FIGS. 5 to 7 in a common bottom view or side view. It is clear from FIG. 16 that and how a non-pressurized, circular passage cross section $A_0$ of the fine jet openings 7 expands into a passage cross section $A_{15}$ which is widened ovally in the circumferential direction of the jet outlet element 6. FIG. 17 illustrates how a non-pressurized diameter value $D_0$ of the side wall 6*b* is increased into a bulged-out diameter value $D_{15}$ at the fluid pressure value of 1.5 bar.

As will be understood by a person skilled in the art, the system design for the bulging behaviour of the jet outlet element 6 is determined above all by suitable selection of the wall thickness for the bottom 6*a* and the side wall 6*b* and of the ratio of axial length to diameter and of the elasticity of the material used, such as the Shore hardness of an elastomer material used. It can further be of importance whether and by what fraction of their axial length the jet outlet elements 6 project beyond the jet disc 4. As needed, the respective jet outlet element can be configured such that with fluid pressure present only its bottom or only its side wall deforms by bulging, or, as explained above, its bottom as well as its side wall deform by bulging.

By virtue of the above-explained bulging, which can also be referred to as breathing, of the jet outlet element 6 in response to the prevailing fluid pressure, the surface of said element remains in movement through the operation of the shower device since the fluid pressure changes during operation, in particular between the non-pressurized condition with the shower device switched off and the respectively provided normal operating pressure of the fluid during active shower device operation. This constant or recurring movement of the surface of the jet outlet element 6 hampers or prevents remaining deposits of dirt and lime particles. This applies in particular also to the region of the fine jet openings 7 which are thus kept free of adhering dirt/lime particles and remain passable over comparatively long operating periods. Moreover, by virtue of this breathing of the jet outlet element 6, any accumulated dirt/lime deposits can usually be automatically detached or discarded through the operation of the shower device.

As explained above, in the exemplary embodiment of FIGS. 5 to 17 the fine jet openings 7 which are circular in cross section in the non-pressurized condition change, with increasing fluid pressure, to fine jet openings 7 which are widened ovally in cross section in the circumferential direction of the jet outlet element 6. In an embodiment variant illustrated in FIGS. 18 to 21, this effect is used in a reverse sense.

In this exemplary embodiment, the fine jet openings 7 in the non-pressurized condition shown in FIG. 18 have a cross section which is widened ovally in the radial direction of the jet outlet element 6. FIG. 19 shows these fine jet openings 7 at a fluid operating pressure of about 0.5 bar. As can be seen therefrom, the oval shape of the fine jet openings 7 in this case already begins to diminish somewhat in the direction of a circular cross-sectional shape in that the widening of the fine jet openings 7 that is already mentioned above sets in in the circumferential direction of the jet outlet element 6. FIG. 20 shows the jet outlet element 6 in the state at a fluid operating pressure of about 1.0 bar. As can be seen, the fine jet openings 7 which are oval in the non-pressurized condition have widened further in the circumferential direction of the jet outlet element 6 and now have an only weakly oval, already rather circular cross section. FIG. 21 shows the state at a fluid operating pressure of about 1.5 bar. As can be seen, the fine jet openings 7 have now widened in the circumferential direction of the jet outlet element 6 in such a way that they have an approximately circular cross section.

For the exemplary embodiment of FIGS. 18 to 21 with the fine jet openings 7 which are oval in the non-pressurized condition, it is determined that the diameter D of the jet outlet element 6 and the passage cross section A of the fine jet openings 7 increase percentagewise with increasing fluid operating pressure to the same degree as indicated above with respect to the exemplary embodiment of FIGS. 5 to 17 for the embodiment variant with the fine jet openings 7 which are circular in the non-pressurized condition.

Thus, depending on the requirement, it is possible with a typical fluid operating pressure in the range from 0.5 bar to 1.5 bar by using the embodiment variant of FIGS. 5 to 17 or the embodiment variant of FIGS. 18 to 21 to provide a shower jet which is produced by the fine jet openings 7 having a rather oval or a rather circular cross section.

In the examples shown the respective jet outlet element is arranged in the associated jet disk opening to be axially unmovable and laterally guided. In alternative embodiments, not shown, the respective jet outlet element is arranged in the associated jet disk opening to be axially movable, i.e. in jet output direction, so that it moves forward by fluid pressure action and thus moves a bit more or nearly completely out of the jet disk opening. This favours, depending on the specific realization, the bulging of its bottom and/or its side wall by the fluid pressure. The skilled person is aware of various possibilities to realize such axially movable support of a jet outlet element in a jet disk opening, so this needs no further explanations here. In further alternative embodiments, not shown, the respective jet outlet element is arranged with lateral distance from the associated jet disk opening, so that its side wall can bulge by the fluid pressure, if needed, not only in a region which axially protrudes out of the jet disk opening, but also in an region which is not axially protruding out of the jet disk opening.

As the shown and aforementioned exemplary embodiments make clear, the invention provides a shower jet outlet device which is comparatively insensitive to clogging phenomena through dirt particles and lime deposits and can be embodied as required in such a way that it can produce a particularly fine, if desired virtually mist-fine shower jet. For this purpose, the fine jet openings can preferably be incorporated with a very small passage cross section in an elastic bottom material of the respective jet outlet element. The fluid-pressure-dependent breathing of the jet outlet element prevents clogging of the small fine jet openings. By virtue of the fact that the cross section of the fine jet openings 7 changes significantly in its area and in its shape, for example between oval and circular as in the embodiments shown, any accumulated dirt/lime particles can be automatically detached or dislodged, and the development of dirt/lime deposits which appreciably constrict the fine jet openings 7 in their free throughflow cross section is effectively counteracted.

It will be understood that, in addition to the shown and the above-explained embodiment variants, the invention encompasses further embodiments of the shower jet outlet device, with the only necessity being that the jet outlet element arranged in the associated jet disc opening is pot-shaped and is arranged with its bottom facing in the jet outlet direction and a plurality of fine jet openings are provided in the bottom. The shower jet outlet device can be used for any conventional type of sanitary shower devices, such as showering devices, kitchen shower devices and shower devices for mixer taps, and non-sanitary shower devices.

What is claimed is:

1. A shower jet outlet device comprising:

a jet disk including at least one jet disk opening and a jet outlet element disposed in the jet disk opening, wherein the jet outlet element is pot-shaped with an outlet-sided bottom, a side wall and a hollow chamber delimited by the bottom and the side wall, the bottom is arranged facing in a jet outlet direction and includes a plurality of fine jet openings, the fine jet openings having an outlet cross section of, in each case, at most 0.2 $mm^2$, and the bottom and the side wall of the jet outlet element are made of an elastic material and the jet outlet element is configured to deform by bulging of the bottom and the side wall of the jet outlet element in response to a fluid operating pressure present in the hollow chamber during active device operation when a fluid jet is emitted through the jet outlet element.

2. The shower jet outlet device according to claim 1, wherein an outer diameter of the bottom and the side wall is at most 10 mm.

3. The shower jet outlet device according to claim 2, wherein the outer diameter of the bottom and the side wall is at most 6 mm.

4. The shower jet outlet device according to claim 1, wherein the bottom includes at least three and at most ten fine jet openings.

5. The shower jet outlet device according to claim 1, wherein the jet outlet element is arranged to be displaceable in the jet outlet opening in parallel to the jet outlet direction between a backward end position and a forward end position, wherein the jet outlet element is in the forward end position when the fluid operating pressure is present in the hollow chamber, and is in the backward end position when the fluid operating pressure is absent in the hollow chamber.

6. The shower jet outlet device according to claim 1, wherein at least one of a diameter and a passage cross section of the side wall of the fine jet openings of the jet outlet element bulge in response to the fluid operating pressure, in relation to a non-pressurized condition, is increased by at least 3% by the fluid operating pressure reaching 0.5 bar.

7. The shower jet outlet device according to claim 1, wherein at least one of a diameter and a passage cross section of the side wall of the fine jet openings of the jet outlet element bulge in response to the fluid operating pressure, in relation to a non-pressurized condition, is increased by at least 8% by the fluid operating pressure reaching 1 bar.

8. The shower jet outlet device according to claim 1, wherein at least one of a diameter and a passage cross section of the side wall of the fine jet openings of the jet outlet element bulge in response to the fluid operating pressure, in relation to a non-pressurized condition, is increased by at least 12% by the fluid operating pressure reaching 1.5 bar.

9. The shower jet outlet device according to claim 1, wherein the bottom and the side wall of the jet outlet element are composed of an elastomer material having a Shore A hardness of at most 75.

10. The shower jet outlet device according to claim 1, wherein the jet outlet element includes a holding shoulder radially salient from the side wall.

11. The shower jet outlet device according to claim 1, wherein the jet outlet element includes spacers axially projecting on an inlet-sided face end of the jet outlet element.

12. The shower jet outlet device according to claim 1, wherein the jet disk has a plurality of jet disk openings and a corresponding number of jet outlet elements disposed in the jet disk openings are provided, wherein the jet outlet elements are molded integrally to a jet outlet plate abutting on an interior side of the jet disk and made of elastic material.

13. The shower jet outlet device according to claim 1, wherein the fine jet openings have an outlet cross section of in each case at most 0.1 $mm^2$.

14. The shower jet outlet device according to claim 1, wherein the bottom and the side wall of the jet outlet element are composed of an elastomer material having a Shore A hardness of at most 40.

15. A shower device including a shower jet outlet device, the shower jet outlet device comprising:

a jet disk including at least one jet disk opening and a jet outlet element disposed in the jet disk opening, wherein the jet outlet element is pot-shaped with an outlet-sided bottom, a side wall and a hollow chamber delimited by the bottom and the side wall, the bottom is arranged facing in a jet outlet direction and includes a plurality of fine jet openings, the fine jet openings having an outlet cross section of, in each case, at most 0.2 $mm^2$, and the bottom and the side wall of the jet outlet element are made of an elastic material and the jet outlet element is configured to deform by bulging of the bottom and the side wall of the jet outlet element, in response to a fluid operating pressure present in the hollow chamber during active device operation when a fluid jet is emitted through the jet outlet element.

16. The shower device of claim 15, configured as a sanitary shower device.

* * * * *